United States Patent [19]

Page

[11] Patent Number: 4,592,101

[45] Date of Patent: Jun. 3, 1986

[54] SOFA-BUNK BED COMBINATION WITH PIVOTABLE CUSHION

[76] Inventor: Elwin H. Page, 2810 E. 26th St., Brooklyn, N.Y. 11235

[21] Appl. No.: 643,886

[22] Filed: Aug. 24, 1984

Related U.S. Application Data

[63] Continuation-in-part of Ser. No. 605,598, Apr. 30, 1984, Pat. No. 4,555,821.

[51] Int. Cl.[4] ..... A47C 17/22; A47C 17/32

[52] U.S. Cl. ..... 5/9 R; 5/12 R

[58] Field of Search ..... 5/8, 9 R, 9 B, 411, 5/12 R, 51 E, 465; 297/218, 219, 223

[56] References Cited

U.S. PATENT DOCUMENTS

| | | | |
|---|---|---|---|
| 1,444,521 | 2/1923 | Pearl | 297/219 |
| 2,723,401 | 11/1955 | Brede-Horst | 5/37 R |
| 2,891,255 | 6/1959 | Simmons | 5/12 R |
| 3,113,325 | 12/1963 | Kamp | 5/17 |

FOREIGN PATENT DOCUMENTS

| | | | |
|---|---|---|---|
| 83420 | 4/1957 | Denmark | 5/9 R |
| 1028036 | 5/1966 | United Kingdom | 5/9 R |

*Primary Examiner*—Alexander Grosz

*Attorney, Agent, or Firm*—Ostrolenk, Faber, Gerb & Soffen

[57] ABSTRACT

In a sofa-bunk bed combination, upstanding, lateral side elements are located toward the rear at the lateral sides of the lower bunk. There is a back board at the top of the upright side elements of the lower bunk. An upper bunk-sofa back is hingedly connected to the back board. Foldable legs are hingedly connected to the underside of the upper support at the front thereof and are folded down to extend to the lower bunk for supporting the upper bunk. The cushion of the sofa-back upper bunk normally rests against the sofa back and is hingedly secured at the rear of the upper bunk. It can be swung upwardly to expose the mattress of the upper bunk beneath the cushion. It can be swung downwardly to lay over that mattress and define the sofa back.

6 Claims, 7 Drawing Figures

FIG. 1
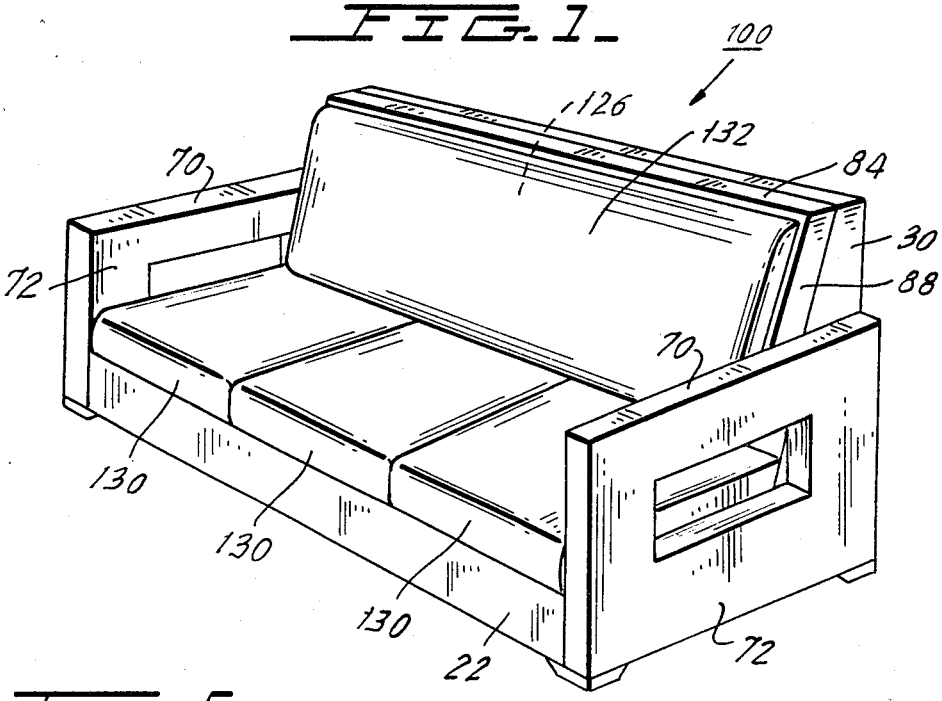
FIG. 5
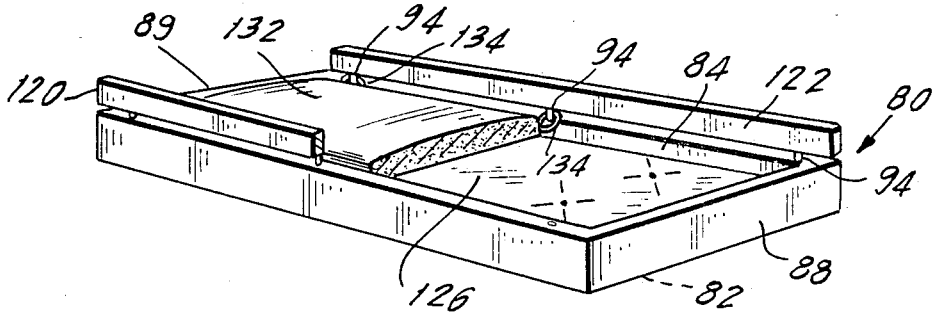
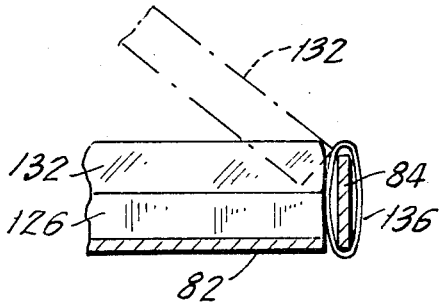
FIG. 6
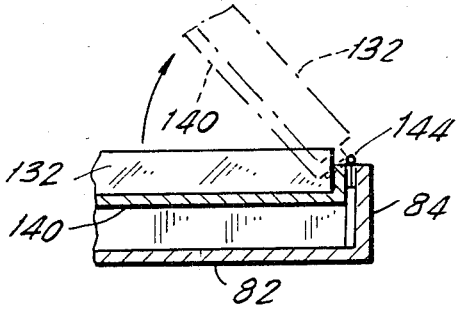
FIG. 7

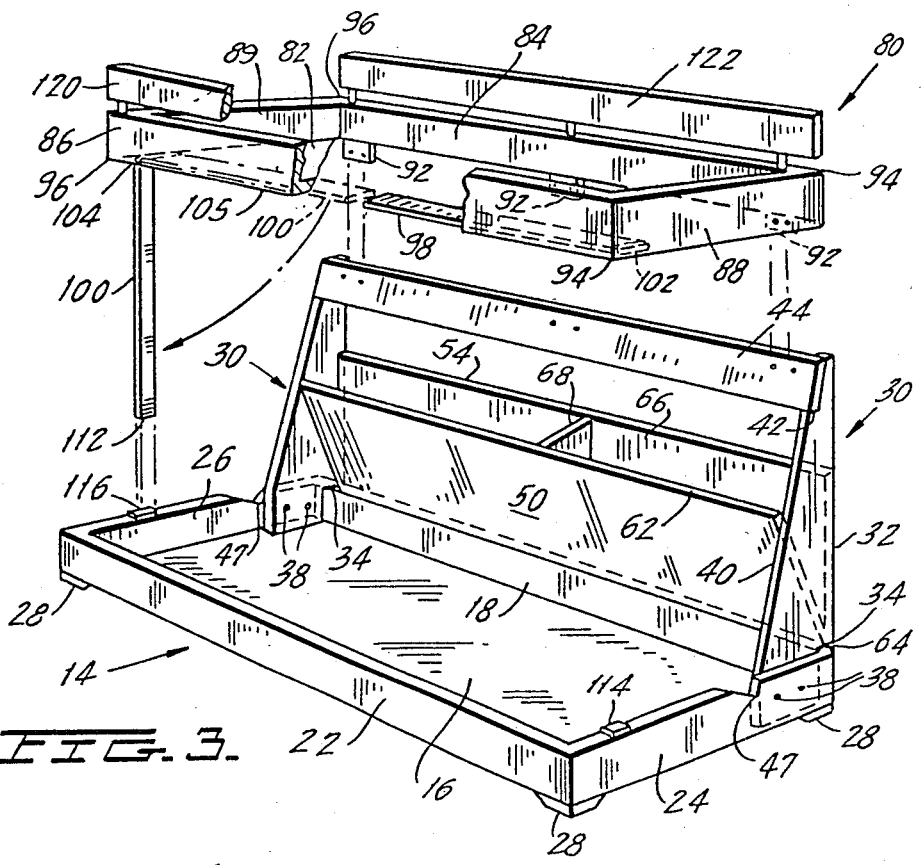
FIG. 3.
FIG. 4.
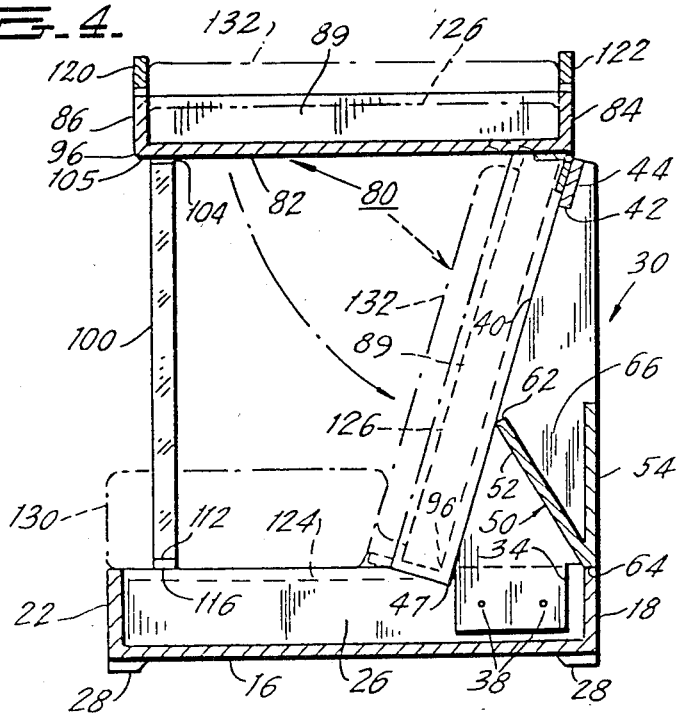

SOFA-BUNK BED COMBINATION WITH PIVOTABLE CUSHION

CROSS REFERENCE TO RELATED APPLICATION

This is a continuation-in-part of Application Ser. No. 605,598, filed Apr. 30, 1984 now U.S. Pat. No. 4,555,821.

BACKGROUND OF THE INVENTION

The present invention relates to a combination sofa and bunk bed wherein the sofa seat can be converted into the bottom bunk of a bunk bed and the sofa back can be pivoted to an upraised horizontal orientation where it will serve as the upper bunk of a bunk bed. More particularly, the invention relates to the manner of attachment and movement of the cushion of the sofa back.

Various combination sofa-bunk beds are known. They include a lower bunk bed-sofa bottom and a unit that is movable to define either the sofa back or the upper bunk. To define the bunks, each has a sleep mattress. To define the sofa, each mattress can be covered by a sofa bottom cushion and a sofa back cushion. Usually, these cushions are completely removed from the sofa when it is a bunk bed. However, it can be more convenient to keep the cushions, and especially the sofa back cushion, with the sofa, even when the mattress is being used with the cushion off.

BRIEF DESCRIPTION OF THE INVENTION

It is the primary object of the invention to provide a sofa-bunk bed combination which is easily converted between the sofa and the bunk bed modes.

It is another object of the invention to be able to keep a sofa cushion with the bunk bed, when the combination is used as a bed.

It is a further object of the invention to have the cushion pivotable between a use and a non-use condition.

The sofa-bunk bed combination of the invention is comprised of a small number of components. There is a bottom support on which the bottom bunk mattress is disposed and on which the sofa seat cushions are removably disposed. At the sides of and toward the rear of the bottom support are side upright elements. These upright elements support the sofa back along with the bottom support when the combination is in the sofa mode. The upright elements support the rear edge of the upper bunk when the combination is in the bunk bed mode. A back board extends across the space between the upright elements, forming together with the upright elements and the bottom support a sufficiently strong and rigid rear support for the upper bunk-sofa back.

When the combination is in the sofa mode, the sofa back is suspended from the top of the back board and is inclined forwardly down into notches formed at the sides of the bottom support, creating a generally triangularly shaped open space between the under-rear surface of the upper bunk-sofa back and the rear side of the bottom support and the front side of the upright elements.

The sofa back-upper bunk unit includes another support, which is hingedly attached to the top of the back board that extends between the upright side elements, and the sofa back-upper bunk pivots between its two modes around the hinge connection.

At the two front corners of the underside of the upper bunk are disposed respective hingedly connected legs, which are foldable between a downwardly depending orientation where they rest upon the bottom support or a folded up orientation under the bottom of the upper bunk-sofa back, so as to not interfere with the lowering of the sofa back into the sofa mode.

The support which defines the bottom bunk and sofa bottom and the support which defines the upper bunk and sofa rear are both framed rectangles with the framing provided by upstanding peripheral frame panels, whereby both the bottom bunk and the upper bunk are open top, short height boxes. This strengthens and rigidifies both the bottom and the upper bunks. This additionally helps hold the mattresses of both the top and bottom bunks in place, especially as the upper bunk is pivoted into and out of the sofa and upper bunk modes. Also, the frame panels of the upper bunk hold the sofa back cushion in place over the upper bunk mattress when the sofa back is tilted up with the cushions in place.

The upper bunk should be light in weight. A spring for the mattress of the upper bunk may be suspended from the frame panels. Or, the mattress may be supported on a light weight plywood panel held by metal straps on to the frame.

The foregoing arrangement permits the mattresses of both the upper and bottom bunks to remain in while the combination is in both the sofa and bunk bed modes. Any bedding, except thick pillows, can also remain in place. The seat cushions which cover the sofa seat and the sofa back will also cover and protect the mattresses and bedding.

Especially following conversion of the combination to its bunk bed mode, it may be desirable to lift the seat cushions off the mattresses, and especially to lift the seat back cushion off the seat back. To retain the seat back cushion with the upper bunk, the cushion is hingedly connected to the edge, and particularly the rear edge of the upper bunk so that the cushion can be swung up and off the mattress or back down over the mattress. For a hinged connection, the cushion itself may be provided with rear edge straps which attach to the upper bunk framework to permit the cushion swinging. Alternatively, the cushion may be surrounded by a surrounding frame that supports and rigidifies the cushion and it is this frame that is attached to the upper bunk framework. Also, typically a sofa back has a plurality of separate cushions. While plural cushions may be used with the inventive as well, providing only a single seat back cushion makes swinging of the cushion simpler. Finally, while the cushion supporting invention is described for use on the upper bunk, it may also be used for the lower bunk, with the cushion attached at the rear of the lower bunk.

The foregoing and other objects and features of the invention will become apparent from the following description of a preferred embodiment of the invention, considered in conjunction with the accompanying drawings.

BRIEF DESCRIPTION OF THE DRAWINGS

FIG. 1 is a perspective view of the bunk bed-sofa combination of the invention in the sofa mode;

FIG. 3 is a perspective, exploded view of the combination without mattresses and cushions;

FIG. 4 is cross-sectional view at the lines 4 in FIG. 2;

FIG. 5 is a perspective view of the top bunk with the seat back cushion attached in one manner;

FIG. 6 is an end view in cross-section showing the seat back cushion attached in a second manner; and FIG. 7 is the same type of view showing the back cushions supported and attached in a third manner.

DESCRIPTION OF A PREFERRED EMBODIMENT

Figure 2:
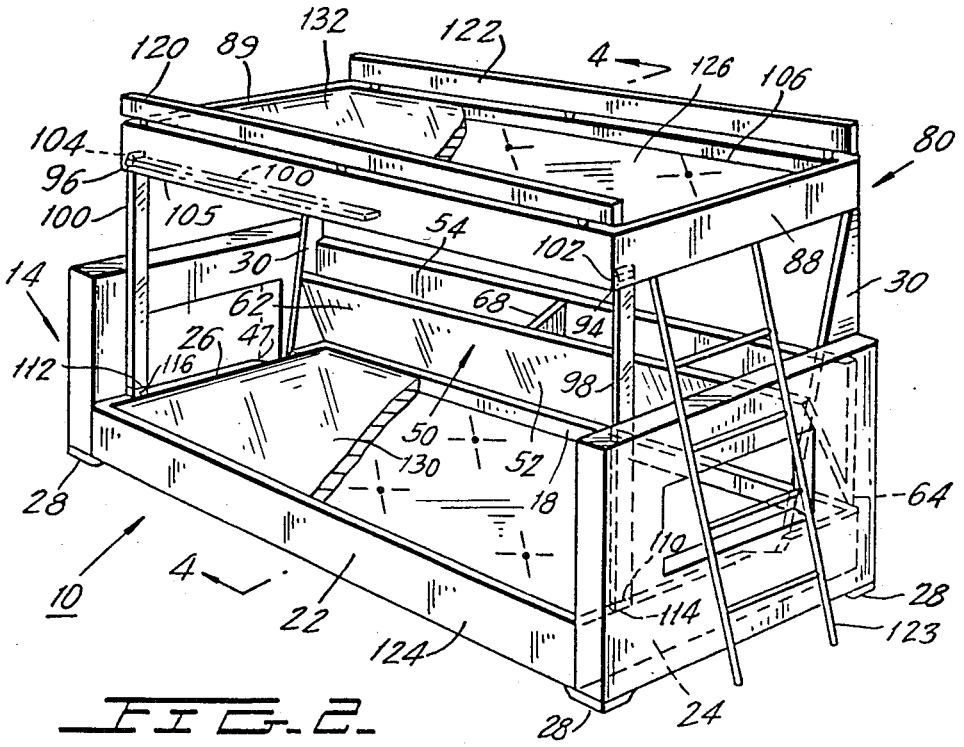
FIG. 2 is a perspective view thereof in the bunk bed mode.

The sofa-bunk bed combination 10 according to the present invention has the sofa mode shown in FIG. 1 and the bunk bed mode shown in FIG. 2. The structure of the present invention permits rapid conversion of the combination between its illustrated modes.

Referring next to FIG. 3, the combination includes the bottom unit 14, including a horizontal, flat bottom support or platform 16 which is rectangular in shape and has the dimensions of a bed mattress. The platform 16 is surrounded by the short height, upstanding, side frame panels, including the front and rear side panels 22, 18 and the left and right side panels 26, 24. These panels define with the platform 16 a fairly rigid supporting framework. Short height feet 28 beneath the corners of the platform 16 raise it above the floor so that the sofa seat cushions will be at the expected sofa height.

At the end of each side panel 24, 26 toward the rear panel 18 and inside each side panel, a respective side upright element 30 is fixedly attached. The back edge 32 of each upright element is flat. The notch 34 at the bottom of the side upright element 30 receives the rear panel 18 therein and the upper wall of the notch 34 rests on the top of the panel 18. The back edge 32 of the upright element continues above the back surface of the panel 18 and this defines the rear side of the sofa-bunk bed combination. The front edge 40 of the upright element 30 is not vertical, but instead inclines rearwardly moving upwardly of the upright element. The front edge 40 defines a surface above which the underside-rear side of the below-described upper bunk-sofa back is disposed to be at the resulting tilt angle of the sofa back. A notch 42 is formed at the top of the front edge 40 of the upright 30 for receiving a supporting back board 44.

The back board 44 is a rigid supporting panel, generally of the same materials and strength as the bottom support panels 16–24, and the board 44 extends between the notches 42 of the two side upright elements 30. The back board 44 rests on the bottom wall of the notches 42 and it is secured there by bolts, and/or adhesive, etc. The resulting bottom unit of the sofa and bed combination is quite sturdy. Separated from the below described upper bunk and sofa back, the bottom unit serves as a bed.

Immediately forward of the upright side elements 30, the side panels 24 and 26 have respective notches 47 which receive the front bottom edge of the upper unit 80 in the sofa mode as shown in FIG. 4.

A storage unit 50 is provided at the rear of the bottom unit 14 of the combination. The storage unit 50 includes a front wall 52, which faces forwardly of the sofa and the bottom bunk, and a rear wall 54. The front and rear walls of the unit 50 are respectively secured to the inner, inwardly facing surfaces of the side upright elements 30, which support the storage unit 50. The rear wall 54 of the storage unit is vertical and would be parallel to the rear edges 32 of the upright elements 30, whereby the storage unit 50 does not project rearwardly of the edge 32 and the vertical edge 32 defines the rear edge of the sofa-bunk bed combination. The front wall 52 of the storage unit is inclined, being tilted rearwardly of the bottom bunk from its top end 62 toward its bottom end 64. Its top end 62 is sufficiently forward to provide access into the interior of the bin space 66 created inside the storage unit by the walls 52 and 54. The top end 62 does not extend further forward than the rear surface of the sofa back when the sofa back is downward in the sofa mode, shown in FIGS. 2 and 4. The top edge 62 of the storage unit 50 extends up only part way along the height of the upright elements 30, so that the bin 66 can be open in the triangular space defined between the rear edges 32 of the upright elements 30 and the rear side of the sofa back. The bottom end 64 of the storage unit 50 terminates above the bottom of the rear panel 18 and the storage unit walls 52, 54 meet at the rear edge 32 of the upright 30, so as to not interfere with a mattress disposed on the platform 16. In addition, there may be an intermediate rigidifying wall 68.

With reference to FIGS. 1 and 2, decorative sofa arms 70 are supported on their uprights 72, which are, in turn, attached to the exterior sides of the bottom side panels 24, 26. The appearance and design of the side arms 70 for the sofa are a matter of choice. For instance, the arms 70 could be provided with storage compartments, in addition to the storage unit 50. The arms may also serve as a ladder to the upper bunk.

The top unit of the combination comprises the top bunk-sofa back 80. That includes a flat, stiff, thin, light weight, plywood platform 82, which is surrounded by four side panels, including the rear panel 84, the opposite front panel 86 and the left and right side panels 88 and 89. The platform 82 is suspended on straps from the panels. The four side panels are secured together and project above the platform 82 for defining a mattress containing lip, which positions the mattress on the platform 82 even as the top bunk-sofa back moves between its sofa and bunk bed modes. In a modification, not shown, a bed spring is suspended from the panels 84, 86, 88 and 89 and the mattress sits on this spring.

Attached at the underside of the rear panel 84 are a plurality of hinges 92 which are detachably connected by bolts, or the like, to the rear side of the back board 44 of the bottom unit of the sofa-bunk bed. When the combination is in the sofa mode, the bottom-forward corners 94 and 96 of the end panels 88 89 rest in the notches 47 in the panels 24 and 26 which defines the inclinations of the back of the sofa.

At the two front corners 94, 96 of the top unit 80, respective folding legs 98, 100 are disposed. They are hingedly connected at 102, 104, respectively, to the underside 105 of the front panel 86. In FIGS. 2–4, they are illustrated in their unfolded, upright condition, at which they support the upper bunk 80 in its upraised condition above the lower bunk. In FIG. 3, in contrast, both of the legs are shown folded up in phantom against the underside of the panel 86 and out of the way, and when both legs are folded up, the upper bunk may be lowered to its position as a sofa back. When unfolded, the bottom ends 110, 112 of the folding legs 98, 100, respectively are seated on the seats or receptacles 114, 116, respectively, atop the corresponding front corners of the panels of the bottom bunk. The seats 114 116 will hold the legs sufficiently securely against undesired folding and against slipping off which would permit the upper bunk to fall. Appropriate securement techniques, such as short length collars for receiving the leg bottom ends 110, 112, and appropriate locking mechanism, as is used with folding table legs, or the like, would prevent the folding legs 98, 100 from undesirably folding until the locking mechanism is released. If desired, an appropriate hydraulic lift mechanism (not shown) may be associated with the legs to aid in lifting the upper bunk.

At the front panel 86 and/or at the rear panel 84, an additional short height upstanding safety board 120 and/or 122 is supported above the upper edge of the panel. This is especially useful at the front side of the upper bunk which also is the bottom of the sofa back. The safety boards protect the occupant of the upper bunk against falling. The safety boards are supported on respective posts which are received in cooperating holes in the panels 84 and 86, from which they can be lifted to remove the safety boards. In FIG. 1, the rear safety board 122 has been removed.

To provide access to the upper bunk, an additional ladder 123 is supported at the underside of the upper bunk which is the rear of the sofa back. The ladder may be hingedly connected to the edge of a side panel, to be folded up when out of use, or the ladder may be received in a channel provided for it. Also, the ladder could be stored in the storage unit 50. If the ladder 123 is hinged to the upper bunk, it should be placed rearwardly enough along the side of the upper bunk so as to not interfere with the storage unit 50, which is adjacent to the bottom half of the folded down sofa back, which corresponds to the front half of the upper bunk.

The lower platform 16 supports upon it a mattress or resilient structure 124 which is held inside the space surrounded by the lower unit side panels 18–26. Similarly, an upper mattress or resilient structure 126 is seated atop the upper platform 82 or atop a spring at that location and the mattress is held inside the space surrounded by the upper unit side panels 84–89. The side panels 84–89 hold the upper mattress 126 in the correct position in both the sofa and bunk bed modes and during movement between those modes.

With bedding on the mattresses, if the user wishes, and when the combination is in the sofa mode, seat bottom cushion or cushions 130 may be simply seated atop the bottom mattress 124 and any bedding thereon. The improvement here is shown in relation to the seat back cushion 132 which is disposed over the upper mattress 126. The improvement could be used for the seat bottom cushion as well, if desired.

The seat back cushion 132 is preferably of single piece construction. It is adapted to be down on the upper bunk and may also be lifted upwardly, for example to lean against the wall behind the rear side of the sofa-bunk bed. To permit this to occur, the seat cushion 132 has appropriate hinge means supporting its rear edge.

For example, as shown in FIG. 5, there may be rings 134 at the rear side of the cushion which rings are wrapped about the posts 94, 96, that can also be seen in FIG. 3. The cushion 132 can remain down, as illustrated, and can be easily flipped up, pivoting about the rings 134.

In place of the rings, as shown in FIG. 6, straps may be provided at the back of the cushion 132, which straps are wrapped about the rear side panel 84, the strap being 136, and the straps permit the cushion 132 to be raised and lowered.

As a further alternative, as sown in FIG. 7, the cushion itself may be surrounded and supported by an additional framework 140, and it is that framework that is hingedly connected to the rear panel 84 of the frame at hinges 144. In this way, the cushion may be lifted off and dropped back down over the mattress 126 beneath it.

Of course, any of the same arrangements might be used for the cushion on the bottom bunk, which would then be lifted up against the wall beneath the upper bunk.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A sofa-bunk bed combination comprising:

a bottom unit, comprising a bottom support for defining a bottom bunk-sofa seat; the bottom support having a front side, a rear side and two lateral sides between the front and rear sides;

upright elements at the lateral sides of the bottom support toward the rear side thereof;

an upper unit comprising an upper support including an upper resilient structure for serving as an upper bunk when the combination is in the bunk bed mode and for serving as a sofa seat back when the combination is in the sofa mode; the upper support also having a respective rear side, an opposite front side, and two lateral sides between the front and rear sides; a hinge connection between the upper support and the upright elements of the bottom unit for enabling pivoting of the upper unit between the bunk bed mode, wherein the upper support is upraised horizontally, and the sofa mode, wherein the upper support is suspended down, such that the front side of the upper support is down toward the lower support;

the upper support being non-foldable, whereby it maintains the same dimensions when it is in the bunk bed mode and when it is extending downward in the sofa mode; during pivoting of the upper support between the upraised bunk bed mode and the downwardly inclined orientation in the sofa mode, the bottom support remaining stationary and non-shifting;

a cushion for being carried upon the upper support;

means attaching the cushion pivotally at the rear side of the upper unit, such that the cushion may be pivoted upwardly off the upper support and downwardly to rest upon the upper support.

2. The combination of claim 1, wherein the attaching means comprises a pivot connection between the cushion on the upper support and the rear side of the upper unit.

3. The combination of claim 2, wherein the pivot connection comprises at least one strap at the cushion on the upper support and extending to and attached on the upper support for enabling the pivoting movement thereof.

4. The combination of claim 1, further comprising a frame surrounding the cushion at the upper support for supporting the cushion; the pivot connection between the cushion and the upper unit being a pivot connection between the frame around the cushion and the upper support.

5. A sofa-bunk bed combination comprising:

a bottom unit, comprising a bottom support for defining a bottom bunk-sofa seat; the bottom support having a front side, a rear side, two lateral sides and a bottom resilient structure between the front and rear sides;

upright elements at the lateral sides of the bottom support toward the rear side thereof;

an upper unit comprising an upper support including an upper resilient structure for serving as an upper bunk when the combination is in the bunk bed mode and for serving as a sofa seat back when the combination is in the sofa mode; the upper support also having a respective rear side, an opposite front side, and two lateral sides between the front and rear sides; a hinge connection between the upper support and the upright elements of the bottom unit for enabling pivoting of the upper unit between the bunk bed mode, wherein the upper support is upraised horizontally and the sofa mode, wherein the upper support is suspended down, such that the front side of the upper support is down toward the lower support;

the upper support being non-foldable, whereby it maintains the same dimensions when it is in the bunk bed mode and when it is extending downward in the sofa mode; during pivoting of the upper support between the upraised bunk bed mode and the downwardly inclined orientation in the sofa mode, the bottom support remaining stationary and non-shifting;

a cushion for being carried on at least one of the bottom unit and the upper unit;

the cushion being pivotally connected at the respective rear side of the respective one of the bottom unit and the upper unit on which the cushion is disposed, such that the cushion may be pivoted upwardly off the respective one of the upper and bottom support and downwardly to rest upon that upper support.

6. The combination of claim 5, wherein the cushion is of one piece between the peripheral edges thereof.

* * * * *